US005187908A

United States Patent [19]

Losensky

[11] Patent Number: 5,187,908

[45] Date of Patent: Feb. 23, 1993

[54] MODULAR WALL PANEL INTERCONNECTION APPARATUS AND METHOD

[75] Inventor: Charles I. Losensky, Grand Rapids, Mich.

[73] Assignee: La-Z-Boy Chair Company, Monroe, Mich.

[21] Appl. No.: 602,424

[22] Filed: Oct. 22, 1990

[51] Int. Cl.[5] ..... E04B 1/38

[52] U.S. Cl. ..... 52/239; 52/584; 52/769; 52/278; 52/747; 160/135; 160/351

[58] Field of Search ..... 52/127.8, 36, 239, 240, 52/584, 285, 769, 771, 773, 775, 747; 160/135, 351; 403/405.1, 406.1

[56] References Cited

U.S. PATENT DOCUMENTS

| | | | |
|---|---|---|---|
| 1,238,215 | 8/1917 | Terrell . | |
| 1,487,856 | 3/1924 | Hauserman et al. . | |
| 2,326,507 | 8/1943 | Welch, Jr. . | |
| 2,424,217 | 7/1947 | Bales . | |
| 2,483,606 | 10/1949 | Albach et al. . | |
| 2,626,198 | 1/1953 | Vanderveld . | |
| 2,643,170 | 6/1953 | Vanderveld et al. . | |
| 2,827,955 | 3/1958 | Hurley | 160/351 |
| 3,178,245 | 4/1965 | Morioka et al. . | |
| 3,228,157 | 1/1966 | Jacobson | 52/239 |
| 3,327,440 | 6/1967 | Watkins | 52/239 |
| 3,341,270 | 9/1967 | Sohl . | |
| 3,377,763 | 4/1968 | Beckman | 52/584 |
| 3,378,320 | 4/1968 | Morgan et al. . | |
| 3,428,108 | 2/1969 | Singer . | |
| 3,788,378 | 1/1974 | Sobel . | |
| 3,846,002 | 11/1974 | Floetotto . | |
| 3,871,435 | 3/1975 | Lopatka . | |
| 3,926,243 | 12/1975 | Lovich et al. . | |
| 3,948,581 | 4/1976 | Helman et al. . | |
| 4,055,373 | 10/1977 | Andresen et al. . | |
| 4,060,294 | 11/1977 | Haworth et al. . | |
| 4,100,709 | 7/1978 | Good . | |
| 4,104,838 | 8/1978 | Hage et al. | 52/239 |
| 4,116,509 | 9/1978 | Smith . | |
| 4,121,645 | 10/1978 | Behr | 160/351 X |
| 4,166,332 | 9/1979 | Donovan . | |
| 4,206,955 | 6/1980 | Cooper . | |
| 4,232,724 | 11/1980 | Brown . | |
| 4,250,676 | 2/1981 | Presby . | |
| 4,344,475 | 8/1982 | Frey . | |
| 4,416,093 | 11/1983 | Salkeld et al. . | |
| 4,516,619 | 5/1985 | Hasbrouck . | |
| 4,567,698 | 2/1986 | Morrisson . | |
| 4,603,530 | 8/1986 | Glockenstein | 52/239 X |
| 4,637,177 | 1/1987 | Long . | |
| 4,644,993 | 2/1987 | Cooper et al. . | |
| 4,733,841 | 3/1988 | Wilson . | |
| 4,821,788 | 4/1989 | Nelson | 52/239 X |
| 4,841,699 | 6/1989 | Wilson et al. . | |
| 4,860,812 | 8/1989 | De Pietro et al. | 52/239 X |
| 4,904,105 | 2/1990 | Myers | 403/405.1 X |
| 5,004,371 | 4/1991 | Sorensen | 52/239 X |

OTHER PUBLICATIONS

Business Interiors article entitled "Sneak Preview: Rose Johnson introduces RJPlus", Sep.-Oct. 1989.

*Primary Examiner*—Robert Canfield

*Attorney, Agent, or Firm*—Harness, Dickey & Pierce

[57] ABSTRACT

A space divider system for subdividing an interior space into distinct work areas is disclosed. The space divider system makes use of modular wall panels having improved interconnection components adapted to interact with tubular mounting frames which are interconnected intermediate to adjacent wall panels. Each wall panel includes a spring-biased upper bracket and a lower bracket each of which is mounted to a respective upper and lower horizontal surface at each corner of the wall panel. The lower bracket has an upturned lip which captures the lower open end of the mounting frame. The upper bracket is normally biased in an open position to permit the mounting frame to be aligned against the wall panel and is thereafter moved downward until its downturned lip captures the open upper end of the mounting frame. Pre-assembly of the upper bracket on each wall panel permits a method of easy and quick assembly and disassembly of the wall panels.

31 Claims, 3 Drawing Sheets

MODULAR WALL PANEL INTERCONNECTION APPARATUS AND METHOD

BACKGROUND AND SUMMARY OF THE INVENTION

The present invention relates generally to a method and apparatus for interconnecting modular wall panels in office space divider systems and, more particularly, to a spring biased bracket assembly for interconnecting the modular wall panels.

In order to meet the changing floor plan requirements for commercial and industrial office space, it is known to divide the available office space into sub-areas or work stations by means of a divider system. Typical divider systems are composed of modular wall panels which are interconnected in a desired spacial pattern. The workstations are then furnished with office furniture and/or cantilever-supported components such as cabinets, shelves and the like. In this manner, an office may be divided into a desired configuration for enclosing related job functions as well as defining traffic avenues. In addition, divider systems create an atmosphere of acoustical and visual privacy while at the same time facilitating intercommunication between the occupants of the integrated work stations.

In general, modular space divider systems are employed to permit rearrangement of the layout for an office work area. Various structural devices and associated methods are known for interconnecting the modular wall panels of a divider system. Among prior patents disclosing space divider systems are the patents to Salkeld, et al, U.S. Pat. No. 4,416,093; Singer, U.S. Pat. No. 3,428,108; Morrison, U.S. Pat. No. 4,567,698 and Sobel, U.S. Pat. No. 3,788,376. However, conventional space divider systems lack adequate versatility and flexibility and must be assembled and disassembled using a large number of separate mounting brackets and fasteners. Accordingly, such divider systems cannot be quickly rearranged without employing skilled personnel.

In view of the foregoing, it is an object of the present invention to provide a versatile and flexible space divider system and interconnection method adapted to partition an open interior space into working sub-areas. The improved divider system and method makes use of modular wall panels having improved interconnection means that may be readily interlocked to create stable partition walls in a broad range of spacial patterns.

Another object of the present invention is to provide a divider system having modular wall panels which may be simply and quickly rearranged into various spacial patterns without the use of a large number of separate mounting brackets, fasteners, and the like. Accordingly, the improved divider system and method of the present invention includes use of modular wall panels having spring biased interconnection means for connecting adjacent panels in a side-by-side or edge-to-edge orientation.

Further objects, advantages and features of the invention will become apparent to those of ordinary skill in the art from the following detailed description and the appended claims taken in conjunction with the following drawings.

DETAILED DESCRIPTION OF THE PREFERRED EMBODIMENT

Figure 1:
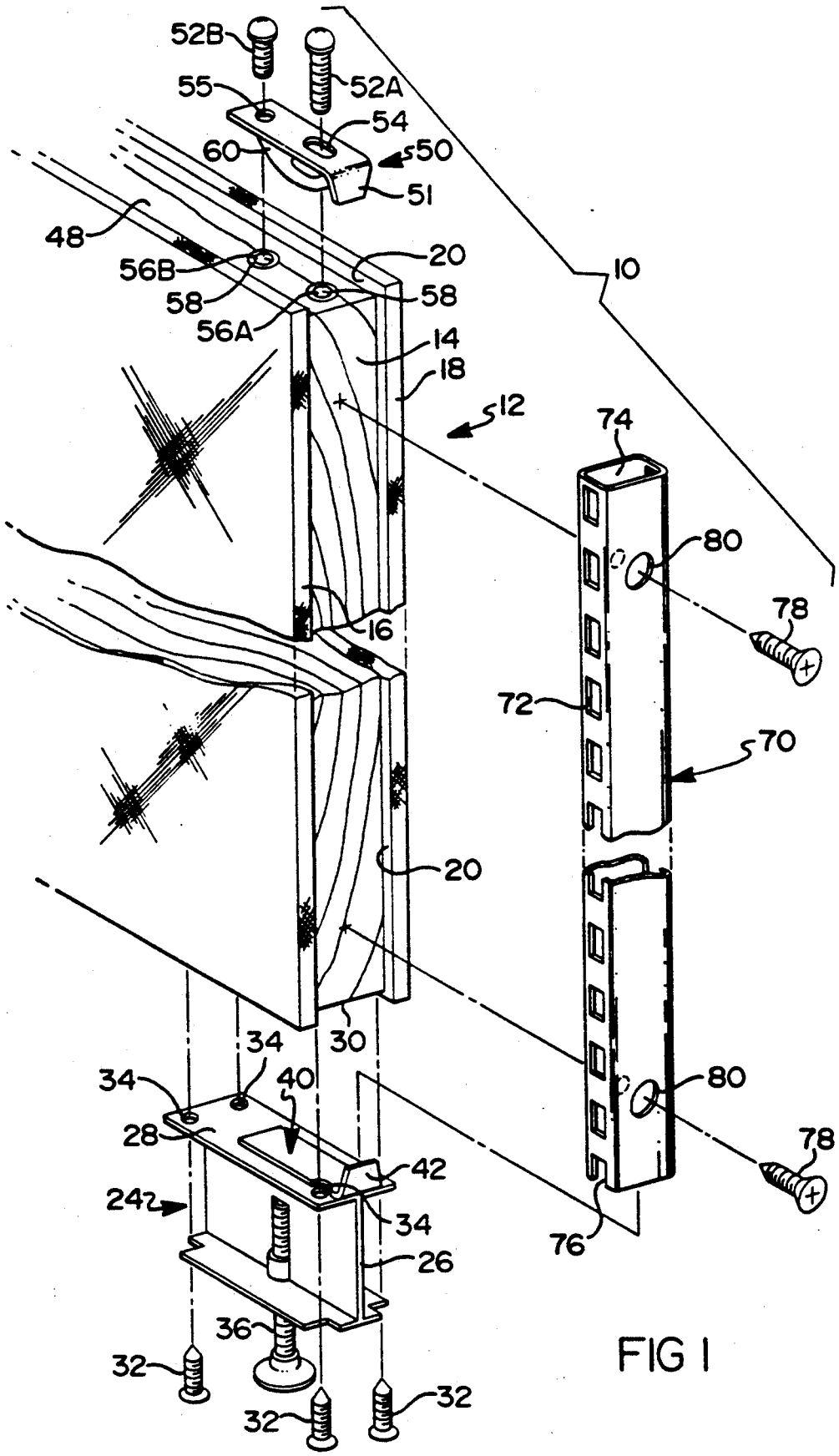
FIG. 1 is an exploded perspective view showing the improved wall panel divider system of the present invention.

In the drawings, and with particular reference to FIG. 1, the reference numeral 10 denotes a modular wall panel in its entirety. In general, the wall panel divider system and method of the present invention includes a plurality of modular wall panels 10 which utilize improved panel interconnection means, the structure and function of which will be described hereinafter in greater detail. More particularly, each wall panel 10 of the present invention is substantially identical in construction to all other panels of the divider system, and are so constructed to be readily interconnected with one or more like wall panels to form a desired spacial room configuration.

Each wall panel 10 includes a main body portion 12 having a core 14 disposed between front and rear boards 16 and 18, respectively, each of which is covered with a layer of fabric or other decorative material. As is known in the art, wall panel 10 is adapted to provide acoustical and visual privacy for occupants working with a workstation area. Furthermore, it will be appreciated that while core 14 is shown along the peripheral edges of the panel as being fabricated from wood, any suitable material is within the scope of this invention. Front and rear planar boards 16 and 18, respectively, are generally rectangular in shape and are dimensioned to be slightly larger in length and height than core member 14. In particular, front and rear boards 16 and 18 are contiguously secured to core member 14 so as to extend outwardly a predetermined distance along the entire periphery of core member 14 for defining a recessed channel 20.

Two or more leveller assemblies 24 are provided in spaced relation along the bottom of each wall panel 10. In particular, each leveller assembly 24 includes an I-beam 26 having an upper transverse flange 28 adapted to be secured to a lower horizontal surface 30 of wall panel 10. Leveller assembly 24 is illustrated as being secured to lower horizontal surface 30 by fastener screws 32 extending through bores 34 on flange 28. Leveller assembly 24 also includes a threaded pedestal 36 adapted to engage the office floor which can be rotatably adjusted to selectively level wall panel 10 relative to the floor and/or an adjacent wall panel. Disposed between upper transverse flange 28 and lower horizontal surface 30 of wall panel 10 is an L-shaped bracket 40 which includes a generally vertically upstanding lip portion 42. While not shown, it will be understood that conventional snap-on base plates or raceway covers are employed to decoratively cover leveller assemblies 24 as well as the space, or raceway, defined between each panel 10 and the office floor. The raceways and associated covers are adapted to house electrical connections, telephone wires, etc. as well as provide convenient electrical outlets for the panel system.

In accordance with the principles of the present invention, means are provided for promoting quick and simple interconnection of adjacent wall panels. More specifically, an upper L-shape bracket 50 is provided along upper horizontal surface 48 of core 14. Upper bracket 50 includes a downturned lip portion 51 adapted to capturingly engage an open upper end of a secondary mounting member as will be described hereinafter in greater detail. While lower bracket 40 is rigidly secured to each lower corner of wall panel 10, upper bracket 50 is secured to upper horizontal surface 48 at each corner of wall panel 10 by a pair of fasteners 52A and 52B. More particularly, fasteners 52A and 52B extend through an elongated first opening or slot 54 and a second opening 55, respectively, in upper bracket 50. Bores 56A and 56B are provided in horizontal surface 48 of core 14 and preferably include a threaded cylindrical insert 58 which is adapted to accept receipt therein of fasteners 52A and 52B, respectively, upon assembly of bracket 50 onto wall panel 10. Elongated slot 54 allows for manufacturing tolerances as well as for permitting "fore and aft" positioning to promote relatively simple alignment and assembly of upper bracket 50 onto core 14.

Figure 2B:
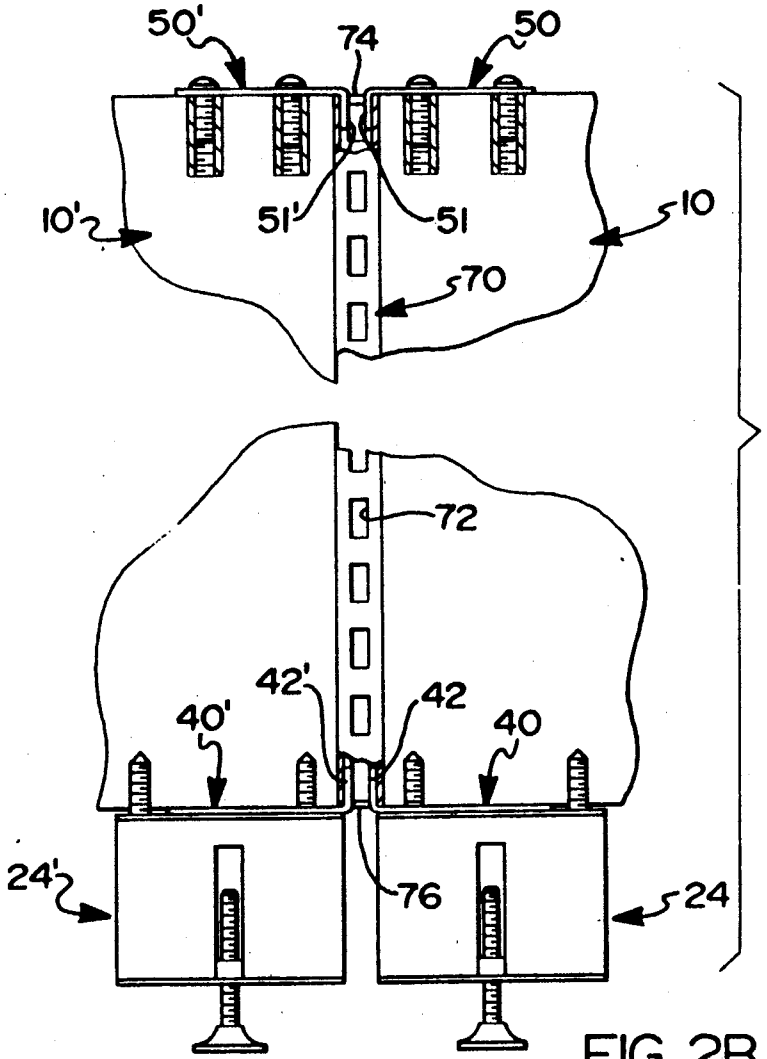
FIGS. 2A and 2B illustrate a method of interconnecting adjacent modular wall panels in a side-by-side planar orientation utilizing the improved panel interconnection means of the present invention.
Figure 2A:
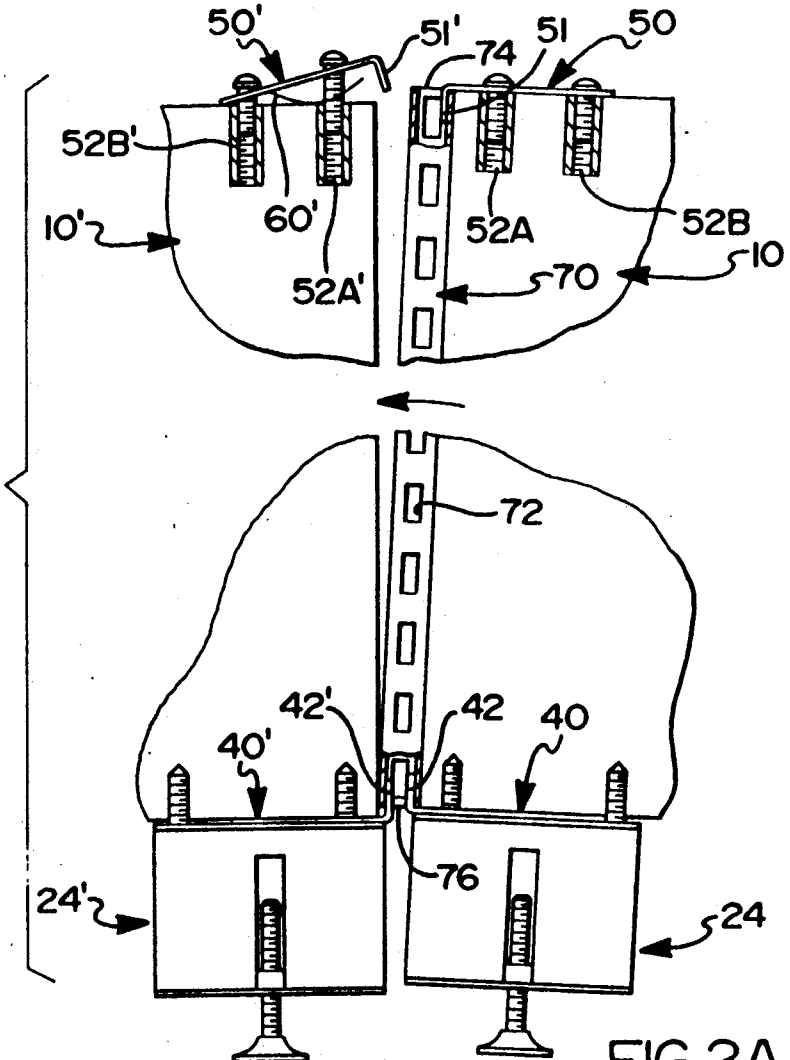
Figure 4:
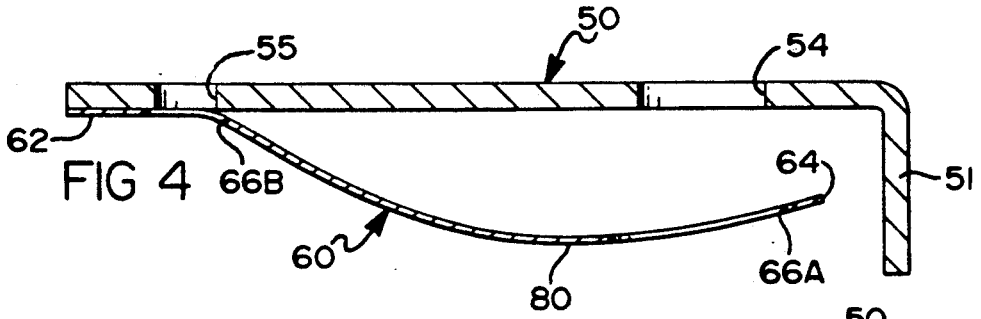
FIG. 4 is a cross-sectional side view taken along lines 4—4 of FIG. 3.
Figure 3:
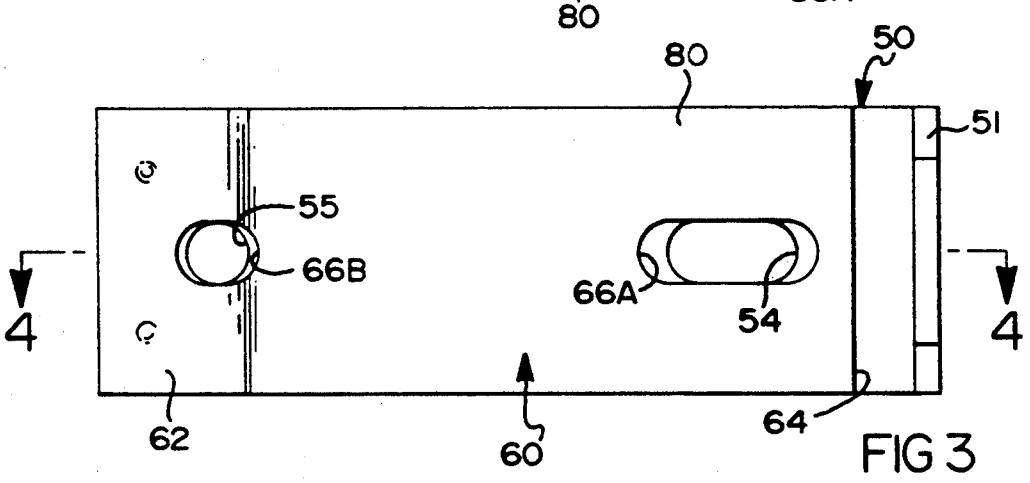
FIG. 3 is a bottom view of a spring biased bracket associated with the panel interconnection means of the present invention.

The improved panel interconnection means of the present invention also includes biasing means located between an underside surface of L-shaped bracket 50 and upper horizontal surface 48 of core member 14. According to the exemplary structural embodiment disclosed, the biasing means is a leaf spring 60 having a first end 62 secured (i.e., welded) to a rearward underside portion of upper bracket 50 and a second "free" end 64 which terminates slightly behind downturned lip portion 51. Preferably, fasteners 52A and 52B extend through elongated slotted apertures 66A and 66B, (see FIGS. 3 and 4) in leaf spring 60 which are oriented in axial alignment with slot 54 and opening 55, respectively. As will be detailed hereinafter, leaf spring 60 is configured to coact with upper horizontal surface 48 of core 14 in a manner to cause upper bracket 50 to be upwardly displaced relative to core 14. In particular, leaf spring 60 is adapted to normally bias upper bracket 50 such that downturned lip 51 is generally pivoted away from upper horizontal surface 48 of core 14. As shown in FIG. 2A, leaf spring 60 normally biases bracket 50 into engagement with a lower radial shoulder formed on the head of fasteners 52A and 52B. Preferably, fastener 52B is threaded farther into its respective bore 56B on wall panel 10 than fastener 52A is threaded into bore 56A to maximize the upward pivoted orientation of bracket 50 relative to upper horizontal surface 48. Preferably, upper bracket 50 is pre-assembled onto wall panel 10 prior to interconnection with a secondary mounting member which is utilized in interconnecting adjacent wall panels 10.

With continued reference to FIG. 1, an exemplary secondary mounting member is illustrated. In particular, the exemplary secondary mounting member is an elongated, rectangular, hollow metal frame 70 which includes a longitudinal row of slots 72 on front and rear faces thereof. Elongated metal frame 70 has an upper open end 74 and a lower open end 76 at its opposite distal ends. Metal frame 70 is adapted to have its opposite lateral sides secured within complimentary vertical portions of recessed channel 20 provided on the facing vertical edge surfaces of adjacent wall panels. To assemble metal frame 70 onto wall panel 10, lower open end 74 is initially disposed over upstanding lip portion 42 of lower bracket 40. As such, lower bracket 40 provides means for locating metal frame 70 relative to wall panel 10. Thereafter, metal frame 70 is pivoted toward wall panel 10 such that one of its lateral sides is disposed adjacent core 14 within the vertical portion of recessed channel 20. As mentioned, upper bracket 50 is preferably pre-assembled onto horizontal surface 48 by partially threading fasteners 52A and 52B into bores 56A and 56B, respectively, prior to assembling metal frame 70 onto wall panel 10. After metal frame 70 is pivoted into contact with core 14 within recessed channel 20, fastener 52A is completely threaded into insert 58 with bore 56A such that upper bracket 50 and downwardly extending lip portion 51 are urged to move downwardly against the bias of leaf spring 60 for lockingly capturing upper open end 74 of metal frame 70. As shown in FIG. 1, it is contemplated that metal frame 70 can be further secured thereafter to core 14 such as by fasteners 78 extending through bores 80 so as to provide additional rigidity an support.

Metal frame 70 is installed as herebefore described to one of adjacent wall panels 10 such that when two wall panels are placed in side-by-side relation, slots 72 are exposed to allow the cantilevered mounting of workstation accessories such as desks, shelves, file cabinets, and the like. Specifically, hooks associated with support structure on the accessories are secured within slots 72. A opaque shield (not shown) can be installed longitudinally within metal frame 70 to inhibit light from passing through slots 72 from one work station to the next.

In addition to cantilevered mounting of accessories, metal frame 70 is used for side-by-side interconnection of adjacent wall panels. With particular reference to FIGS. 2A and 2B, the improved panel interconnection method of the present invention is more clearly illustrated. A first wall panel 10, having metal frame 70 mounted thereto in the manner previously described, is shown being interconnected to a substantially identical second wall panel 10'. The adjacent wall panels 10 and 10' are simply and quickly interconnected by inserting lower open end 76 of metal frame 70 over upstanding lip portion 42' of lower bracket 40' secured to second wall panel 10'. Thereafter, first wall panel 10 is lowered or pivoted to align the opposite lateral side of metal frame 70 within the complimentary vertical portion of the recessed channel formed on second wall panel 10'. In this manner, upper open end 74 of metal frame 70 is aligned with downwardly extending lip portion 51' of upper bracket 50' secured to second wall panel 10'. Once metal frame 70 is aligned within the complimentary facing recessed vertical channels formed on the first and second wall panels, fasteners 52A' and 52B' are tightened for lowering upper bracket 50' downwardly until lip portion 51' securely engages upper open end 74 of frame 70, thereby clamping frame 70 against core 14' of panel 10'.

Referring now to FIGS. 1 through 4, the structure and function of upper bracket 50 is shown in greater detail. In particular, leaf spring 60 is shown as having a generally sinusoidal cambered surface 80. A portion of cambered surface 80 engages upper horizontal surface 48 of core 14 such that when fasteners 52A and 52B are partially threaded into bores 56A and 56B, respectively, upper bracket 50 is normally displaced to a "raised" position (FIG. 2A). Subsequent tightening of fastener 52A into bore 56A tends to overcome the normal compressive biasing force of leaf spring 60 whereby lip portion 51 is generally pivoted downwardly so as to capture upper open end 74 of tubular frame 70. While the embodiment illustrated incorporates use of a leaf spring 60, it should be understood that any suitable biasing member adapted for normally biasing bracket 50 in the manner disclosed is within the fair scope of this invention.

Figure 5:
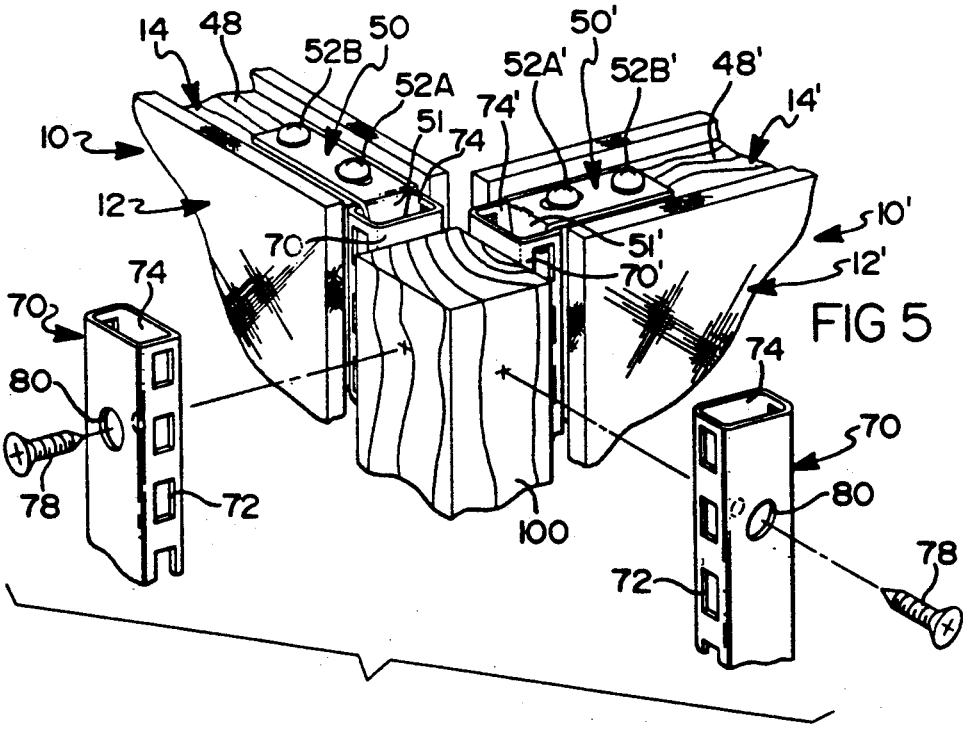
FIG. 5 is an exploded perspective view showing a method of interconnecting adjacent modular wall panels in side-by-side angular orientation.

Referring now to FIG. 5, a method for interconnecting adjacent wall panels in an angular orientation is illustrated. In general, a multi-sided corner post 100 is provided to which at least two elongated metal frames 70 are mounted. More specifically, the exemplary embodiment shown in FIG. 5 illustrates utilization of four (4) metal frames 70 secured to the four (4) sides of corner post 100. Each of the frames 70 are mounted to corner post 100 by fasteners 78 extending through bores 80 in the metal frames. While in the embodiment shown, corner post 100 is wood, it will be appreciated that corner post 100 could be fabricated from other suitable materials such as a hollow metal tube and the like.

Corner post 100 is adapted to provide approximately 90° angular interconnections between adjacent wall panels. However, it is to be understood that various multi-sided corner posts can be designed to accommodate virtually any angular interconnection desired. In accordance with the panel interconnection method previously described, adjacent wall panels 10 and 10' are individually interconnected to corner posts 100 by inserting the lower open end of metal frame 70 over the upstanding lip portion of their respective lower brackets. Thereafter, wall panel 10 is aligned relative to upper open end 74 of metal tube 70 such that metal tube 70 is disposed within the vertical portion of channel 20. Once in alignment, fastener 52A is tightened against the spring biasing of the leaf spring (not shown) so as to pivot upper bracket 50 downwardly until it securely engages upper open end 74 of frame member 70. Thereafter, second panel 10' is similarly installed in angular relation to a second metal frame 70' secured to corner post 100.

While not shown, it will be appreciated that the upper horizontal portion of panel 10 will be enclosed with a decorative trim strip following interconnection of adjacent panels. The decorative trim strip is easily removed when rearrangement of wall panels 10 is desired.

It, thus, will be seen from the above description that the present invention comprises novel features for use in a wall divider system. The invention as described also provides a unique wall panel structure for use in a modular wall panel system. Furthermore, the invention includes apparatus for interconnecting in side-by-side relation any two of a plurality of wall panels of the type used in modular divider systems. In addition to the structural features found in the present invention, a method of interconnecting modular wall panels for subdividing an interior space into work areas having a desired spacial pattern is also described.

While a particular embodiment of the present invention has been described and shown in the foregoing specification and drawings, it will be appreciated that the various principles and features of the invention are susceptible to numerous modifications and applications. Accordingly, it should be understood that the foregoing disclosure is intended to be merely illustrative and exemplary in nature.

What is claimed is:

1. A modular divider system for subdividing an interior space into work areas having a desired spacial pattern comprising:

a plurality of wall panels;

a plurality of mounting frames having a lower open end and an upper open end, each of said mounting frames having first and second opposing sides and front and rear faces therebetween, each of said front and rear faces having support means for supporting at least one accessory component therefrom; and panel interconnection means for interconnecting any two of said plurality of wall panels in side-by-side relation such that one of said plurality of mounting frames is disposed between said two wall panels, said first and second opposing sides of said one mounting frame disposed between complimentary vertical sides of said two wall panels for exposing said support means, said panel interconnection means including locator means associated with a lower portion of each of said complimentary vertical sides of said two wall panels for locating said lower open end of said mounting frame relative thereto, and bracket means associated with an upper portion of each of said complimentary vertical sides of said wall panels for capturing said upper end of said mounting frame thereby interlocking said two wall panels, said bracket means having biasing means for normally biasing said bracket means to a first position away from said wall panels and fastener means for urging and retaining said bracket means in a second position adjacent said wall panels for capturing sand securing said upper open end of said mounting frame to said wall panels.

2. The modular divider system of claim 1 wherein said locator means is a lower bracket rigidly secured to a lower horizontal surface at each vertical side of said wall panels, said lower bracket having an upwardly extending lip portion disposed outwardly from said vertical sides of said wall panels and adapted for capturing one of said first and second opposing sides of said mounting frame upon insertion of said lower open end thereof over said upwardly extending lip portion.

3. The modular divider system of claim 2 wherein said bracket means is an upper bracket which is removably secured by said fastener means to an upper horizontal surface at each vertical side of said wall panels, said upper bracket having a downwardly extending lip portion displaced outwardly from said vertical sides of said wall panels and adapted for capturing one of said first and second opposing sides of said mounting frame upon tightening of said fastener means so as to secure said mounting frame to said wall panels.

4. The modular divider system of claim 3 wherein said biasing means is disposed between said upper bracket and said upper horizontal surface for normally biasing said downwardly extending lip portion to said first position.

5. The modular divider system of claim 4 wherein said first and second opposing sides of said mounting frame are aligned between said complimentary vertical sides of adjacent wall panels and said upper bracket is retained in said second position in opposition to the biasing force of said biasing means.

6. The modular divider system of claim 4 wherein one of said first and second opposing sides of said mounting frame is secured adjacent to a vertical side of a first wall panel prior to securing the other of said first and second opposing sides of said mounting frame to a complimentary vertical side of an adjacent second wall panel.

7. The modular divider system of claim 4 wherein said biasing means is a leaf spring having a cambered surface which is adapted to coact with said upper horizontal surface of said wall panel for normally biasing said upper bracket to said first position.

8. The modular divider system of claim 7 wherein said leaf spring has a first end affixed to said upper bracket and a second free end which terminates rearwardly of said downwardly extending lip portion, said upper bracket and leaf spring having aperture means extending therethrough for permitting said fastener means to secure said upper bracket to said upper horizontal surface of said wall panel.

9. The modular divider system of claim 4 further including at least one multi-sided corner post having at least two mounting frames longitudinally secured thereto and adapted to interconnect at least two of said plurality of wall panels in an angular arrangement.

10. The modular divider system of claim 4 wherein said support means comprises a longitudinal row of slots through said front and rear faces of said mounting frame which are adapted to receive mounting hooks extending from said accessory components.

11. The modular divider system of claim 4 wherein each of said wall panels comprises a generally rectangular core member having first and second generally rectangular boards affixed to front and rear surfaces thereof, said first and second boards sized to be slightly larger than said core so as to define a recessed channel on said vertical sides of said wall panels such that first and second opposing sides of said mounting frames are adapted to be secured therein.

12. A modular wall panel for use in a divider system of the type used in subdividing an interior space into work areas having a desired spacial pattern, the divider system including mounting frames for supporting at least one accessory component therefrom, said modular wall panel comprising:

a relatively rigid body member; and body interconnection means for interconnecting a mounting frame to a vertical side of said body member, said body interconnection means including locator means associated with a lower portion of said vertical side of said body member for locating and retaining a lower open end of the mounting frame relative thereto, and bracket means associated with an upper portion of said vertical side of said body member for lockingly engaging an upper open end of the mounting frame so as to interlock said mounting frame to said body member, said bracket means having biasing means for normally biasing said bracket means to a first position away from said body member and fastener means for urging and retaining said bracket means in a second position adjacent said body member for capturing and securing the upper open end of the mounting frame to said body member.

13. The modular wall panel of claim 12 wherein said locator means is a lower bracket rigidly secured to a lower horizontal surface at each vertical side of said body member, said lower bracket having an upwardly extending lip portion disposed outwardly from each vertical side of said body member and adapted for capturing the mounting frame upon insertion of the lower open end thereof over said upwardly extending lip portion.

14. The modular wall panel of claim 13 wherein said bracket means is an upper bracket which is removably secured by said fastener means to an upper horizontal surface at each vertical side of said body member, said upper bracket having a downwardly extending lip portion displaced outwardly from each vertical side of said body member and adapted for capturing the mounting frame upon tightening of said fastener means so as to secure the mounting frame to said body member.

15. The modular wall panel of claim 14 wherein said biasing means is disposed between said upper bracket and said upper horizontal surface for normally biasing said downwardly extending lip portion to said first position.

16. The modular wall panel of claim 15 wherein one lateral edge of a mounting frame is secured to one of said vertical sides of said body member.

17. The modular wall panel of claim 15 wherein said biasing means is a leaf spring having a cambered surface which is adapted to coact with said upper horizontal surface of said body member for normally biasing said upper bracket to said first position.

18. The modular wall panel of claim 17 wherein said leaf spring has a first end affixed to said upper bracket and a second free end which terminates rearwardly of said downwardly extending lip portion, said upper bracket and said leaf spring having aperture means extending therethrough for permitting said fastener means to secure said upper bracket to said upper horizontal surface of said body member, said leaf spring acting to bias said upper bracket into engagement with said fastener means such that partial installation of said fastener means into said aperture means defines said first position.

19. The modular wall panel of claim 15 wherein said body member is a generally rectangular core member having first and second generally rectangular panel members affixed to front and rear surfaces thereof, said first and second members being sized to be slightly larger than said core so as to define a recessed channel on said vertical sides of said body member for aligning and securing the mounting frame therein.

20. A method of interconnecting modular wall panels for subdividing an interior space into work areas having a desired spacial pattern, said method comprising the steps of:

providing a plurality of modular wall panels;

providing a plurality of tubular mounting frames each having a lower open end and an upper open end;

securing a lower bracket at each corner of said wall panels on a lower horizontal edge surface thereof, said lower bracket having an upstanding lip located outwardly of a vertical edge surface of said wall panel;

securing an upper bracket at each corner of said wall panel to an upper horizontal edge surface thereof, said upper bracket having a downwardly extending lip located outwardly of said vertical edge surface;

biasing said downwardly extending lip of said upper bracket in a direction away from said wall panel;

inserting said lower open end of a first tubular mounting frame over said upstanding lip of said lower bracket secured to a first wall panel;

aligning said first tubular mounting frame in abutting engagement with said vertical edge surface of said first wall panel;

urging said upper bracket on said first wall panel toward said upper horizontal edge surface of said first wall panel until said downwardly extending lip is disposed within said upper open end of said first tubular mounting frame;

securing said upper bracket for lockingly engaging said upper open end of said first tubular mounting frame;

inserting said open lower end of said first tubular mounting frame onto said upstanding lip of said lower bracket secured to a second wall panel;

aligning said first tubular mounting frame in abutting engagement with a complimentary vertical edge surface of said second wall panel;

urging said upper bracket on said second wall panel toward said upper horizontal edge surface of said second wall panel until said downwardly extending lip is disposed within said upper open end of said first tubular mounting frame; and securing said upper bracket for lockingly engaging said upper open end of said first tubular mounting frame, whereby said first and second wall panels are interconnected in side-by-side planar relation.

21. The method of claim 20 further comprising the steps of:

providing at least one multi-sided corner post, said corner post adapted for interconnecting a third wall panel in a desired edge-to-edge adjacent angular relation to one of said first and second wall panels;

securing second and third tubular mounting frames to adjacent vertical sides of said corner post for defining said angular relation;

inserting said lower open end of said second tubular mounting frame onto said upstanding lip on said lower bracket secured to an outermost vertical edge of one of said first and second wall panels;

aligning said second tubular mounting frame in abutting engagement with said outermost vertical edge surface on said one of said first and second wall panels;

urging said upper bracket on said one of said first and second wall panels toward said upper horizontal edge surface thereof until said downwardly extending lip is disposed within said upper open end of said second tubular mounting frame;

securing said upper bracket for lockingly engaging said upper open end of said second tubular mounting frame, whereby said one of said first and second wall panels is interconnected to said corner post;

aligning said third tubular mounting frame in abutting engagement with a vertical edge surface of said third wall panel;

urging said upper bracket on said third wall panel toward said upper horizontal edge surface of said third wall panel until said downwardly extending lip is disposed within said upper open end of said third tubular mounting frame; and securing said upper bracket for lockingly engaging said upper open end of said third tubular mounting frame, whereby said third wall panel is interconnected to said corner post in adjacent angular relation to one of said first and second wall panels.

22. The method of claim 19 wherein said urging and securing steps comprise installing threaded fasteners through apertures in said upper bracket, said threaded fasteners being adapted for receipt in bores formed in said upper horizontal edge surface of said wall panels.

23. The method of claim 22 wherein said biasing step includes providing a leaf spring between said upper bracket and said upper horizontal edge surface, said leaf spring having a cambered surface adapted for urging said upper bracket into engagement with a head portion of said threaded fasteners.

24. An apparatus for interconnecting any two of a plurality of wall panels of the type used in modular divider systems in side-by-side relation, said apparatus comprising:

a plurality of mounting frames adapted to be disposed between adjacent wall panels each said mounting frame having first and second opposing sides and a lower open end and an upper open end;

a locator bracket associated with a lower portion of each of the wall panels for locating and retaining the lower open end of one of said mounting frames;

bracket means associated with an upper portion of the wall panels for lockingly engaging said upper open end said one of said mounting frames for interconnecting said one of said mounting frames to a wall panel;

biasing means for normally biasing said bracket means to a first position away from said wall panel; and fastener means extending through said bracket means and said biasing means for urging and retaining said bracket means in a second position adjacent said wall panel for capturing and securing the upper open end said one of said mounting frames said wall panel.

25. The apparatus of claim 24 wherein said bracket means is an upper bracket which is removably secured by said fastener means to an upper horizontal surface at corners of the wall panels, said upper bracket having a downwardly extending lip portion displaced outwardly from the wall panels and adapted for capturing one of said first and second opposing sides of said one of said mounting frames upon tightening of said fastener means so as to secure the mounting frame to the wall panel.

26. The apparatus of claim 25 wherein said biasing means is disposed between said upper bracket and said upper horizontal surface for normally biasing said downwardly extending lip portion to said first position.

27. The apparatus of claim 26 wherein said opposing sides of the mounting frames are aligned between complementary vertical sides of adjacent wall panels upon said upper bracket being moved to said second position in opposition to the biasing force of said biasing means.

28. The apparatus of claim 27 wherein one of the opposing sides of said one of said mounting frame is secured adjacent to a vertical side of a first wall panel prior to securing the other of the opposing sides of said one of said mounting frames to a complimentary vertical side of an adjacent second wall panel.

29. The apparatus of claim 26 wherein said biasing means is a leaf spring having a cambered surface which is adapted to coact with a upper horizontal surface of the wall panel for normally biasing said upper bracket to said first position.

30. The apparatus of claim 29 wherein said leaf spring has a first end affixed to said upper bracket and a second free end which terminates rearwardly of said downwardly extending lip portion, said upper bracket and leaf spring having aperture means extending therethrough for permitting said fastener means to secure said upper bracket to the upper horizontal surface of the wall panel.

31. The apparatus of claim 30 wherein each of the wall panels comprises a generally rectangular core member having first and second generally rectangular boards affixed to front and rear surfaces thereof, said first and second boards sized to be slightly larger than said core so as to define a recessed channel on said vertical sides of said wall panels such that first and second opposing sides of said mounting frames are adapted to be secured therein.

* * * * *